US005556363A

United States Patent [19]

Hutchins

[11] Patent Number: 5,556,363

[45] Date of Patent: Sep. 17, 1996

[54] LINEAR MOVEMENT, TRUNK MUSCLE EXERCISE METHOD

[76] Inventor: Kenneth M. Hutchins, 350 Hidden Pines Cir., Casselberry, Fla. 32707

[21] Appl. No.: 545,086

[22] Filed: Oct. 19, 1995

Related U.S. Application Data

[60] Division of Ser. No. 219,974, Mar. 30, 1994, Pat. No. 5,460,587, which is a continuation-in-part of Ser. No. 877,619, May 1, 1992, Pat. No. 5,299,998, which is a continuation-in-part of Ser. No. 598,131, Oct. 16, 1990, Pat. No. 5,147,259.

[51] Int. Cl.[6] ..... A63B 23/02

[52] U.S. Cl. ..... 482/101; 482/134; 482/135

[58] Field of Search ..... 482/91–101, 112, 482/114, 128–130, 133–139, 148

[56] References Cited

U.S. PATENT DOCUMENTS

| | | | |
|---|---|---|---|
| 1,548,849 | 9/1923 | Ruden | 482/135 X |
| 4,632,393 | 12/1986 | Van Noord | 482/133 |
| 4,653,750 | 3/1987 | McIntyre | 482/134 X |
| 4,666,152 | 5/1987 | Jones | 482/137 |
| 4,702,108 | 10/1987 | Amundsen et al. | 482/133 X |
| 5,085,429 | 2/1992 | Van Der Hoeven | 482/130 |

*Primary Examiner*—Linda C. Dvorak
*Assistant Examiner*—John Mulcahy
*Attorney, Agent, or Firm*—James H. Beusse

[57] ABSTRACT

An exercise method for strengthening the lower back muscles has a horizontally-movable plunger that contacts the abdomen of a user for linearly applying the force of a weight stack to resist lower back and pelvic muscle flexion and extension by a seated user. The plunger is attached to a carriage mounted for horizontal movement on rails. A cable connection between the carriage and the weight stack includes a cam for varying resistance with changes in position of the plunger. The backrest and seat are made optionally tiltable.

5 Claims, 4 Drawing Sheets

LINEAR MOVEMENT, TRUNK MUSCLE EXERCISE METHOD

This is a divisional, of application Ser. No. 08/219,974 filed Mar. 30, 1994, now U.S. Pat. No. 5,460,587, which is a continuation-in-part of U.S. patent application Ser. No. 07/877,619, filed May. 1, 1992, now U.S. Pat. No. 5,299,998; which is a continuation-in-part of U.S. patent application Serial No. 07/598,131, filed Oct. 16, 1990, now U.S. Pat. No. 5,147,259.

BACKGROUND OF THE INVENTION

This invention relates to an exercise method for strengthening muscles associated with the trunk; and, in particular, to apparatus for applying a variable resistance linearly to the trunk to oppose trunk extension or flexion involving contraction and/or uncontraction of trunk musculature.

The muscles associated with flexion/extension of the trunk (hereafter "trunk muscles") comprise both back and abdominal muscular structures. Posterior trunk extension, for example, involves the erector spinae muscles which, together with its prolongations, fill up the vertebral groove on each side of the spine. Lateral trunk flexion to either the right or left involves the principal abdominal structures (external or descending obliques, internal or ascending obliques, transversalis and abdominal rectus), as well as the latissimus dorsi and other more minor trunk/abdominal structures. The trunk muscles can be exercised by contraction (shortening) or release (lengthening) under load. The term "uncontraction" is used herein to offset the implied exertional volition of "contraction," and indicates a controlled release and muscular assertion during lengthening.

Applicant's U.S. patent application Ser. No. 07/598,131 (now U.S. Pat. No. 5,147,259) describes an exercise machine and method for strengthening the abdominals through anterior trunk flexion using a linearly movable plunger directed against the back to apply a variable resistance to the trunk to oppose the flexion. The '131 device includes means to restrain arm and leg movement in order to minimize the involvement of hip flexion. Applicant's U.S. patent application Ser. No. 07/877,619 (now U.S. Pat. No. 5,299,998) addresses further developments of the linear resistance application method, and addresses exercise machine embodiments particularly suited for posterior trunk extension and lateral trunk flexion. Early experience with linearly applied resistance using the '131 and '619 devices has been favorable, and the present application is drawn to the exercise method implemented utilizing those devices.

SUMMARY OF THE INVENTION

It is an object of the present invention to provide an exercise method for strengthening the abdominal muscles as well as the back muscles through contraction/uncontraction of the abdominal/back muscles against the opposing force of a variable resistance applied linearly to the trunk.

It is a further object of the invention to provide a linear movement, abdominal/back muscle exercise method such as can be implemented using devices of the type described in Applicant's parent U.S. patent application Ser. Nos. 07/598,131 and 07/877,619, and which is particularly suited to strengthening the abdominal muscles through lateral flexion and the back muscles (erector spinae) through extension of the trunk.

In one aspect of the invention, an exercise method utilizes a movable member that contacts the trunk of a user and is displaced linearly to apply an opposing variable force to resist flexion or extension of the trunk.

In a first embodiment of the invention, described in greater detail below, the method is implemented using a machine that has a linearly movable member in the form of a push-rod or plunger with a convex-shaped pad at a free end which is positioned to contact the middle or lower back of the user. The user's legs are restrained by a fixed member in the form of a nest of leg contacting pads that serve to maintain the position of the user's thighs. The machine also includes an arm restraining member in the form of a fixed brace to immobilize the arms. Means is provided to connect a weight-selectable weight stack to the plunger to provide resistance that varies in a controlled manner according to the degree to which the user's back is flexed. In performing the exercise method, the user pushes the middle or lower back into the padded end of the linear movement arm while containing reactionary forces by use of the thigh and arm immobilizing members. In so doing, the chest is depressed and the thoracic spine, the lumbar spine, the sacrum, and the pelvis are flexed. To accommodate this flexion, some rotation occurs in the hip and shoulder joints. Because arm and leg movement is restrained, the involvement of hip flexion during the back flexing is minimized, and the hip rotation that occurs during torso flexion is extension rather than flexion.

In another embodiment, described in greater detail below, the linearly movable member takes the form of a push-rod or plunger that has a pad at its free end which is positioned to contact the rectus or oblique/transversalis muscle regions of the user. The utilized machine includes a height adjustable seat and backrest, with swivel options, and means connecting a weight-selectable weight stack to the plunger to provide resistance that varies in a controlled manner according to the degree to which the plunger is moved as the user's trunk undergoes posterior extension or lateral flexion. In performing the exercise method using this machine, the user is seated either frontwise or sidewise facing the plunger with the padded end of the plunger touching the user's mid-ventral or mid-lateral trunk at either the front or side of the abdomen. As the user alternately contracts and uncontracts the abdominals while seated in a sideways positioning, the trunk is respectively laterally flexed and unflexed in a coronal plane. As the user alternately contracts and uncontracts his erector spinae while seated facing the plunger, the trunk is respectively extended and flexed in a sagittal plane. Some expansion of the abdominal wall occurs coincident with trunk extension against the plunger end. This causes the plunger arm to be moved linearly to lift the weight stack by an amount that varies with the distance the plunger is moved.

BRIEF DESCRIPTION OF THE DRAWINGS

Embodiments of the invention have been chosen for purposes of illustration and description, with reference to the accompanying drawings, wherein.

Throughout the drawings, like elements are referred to by like numerals.

DETAILED DESCRIPTION OF PREFERRED EMBODIMENT

Figure 1:
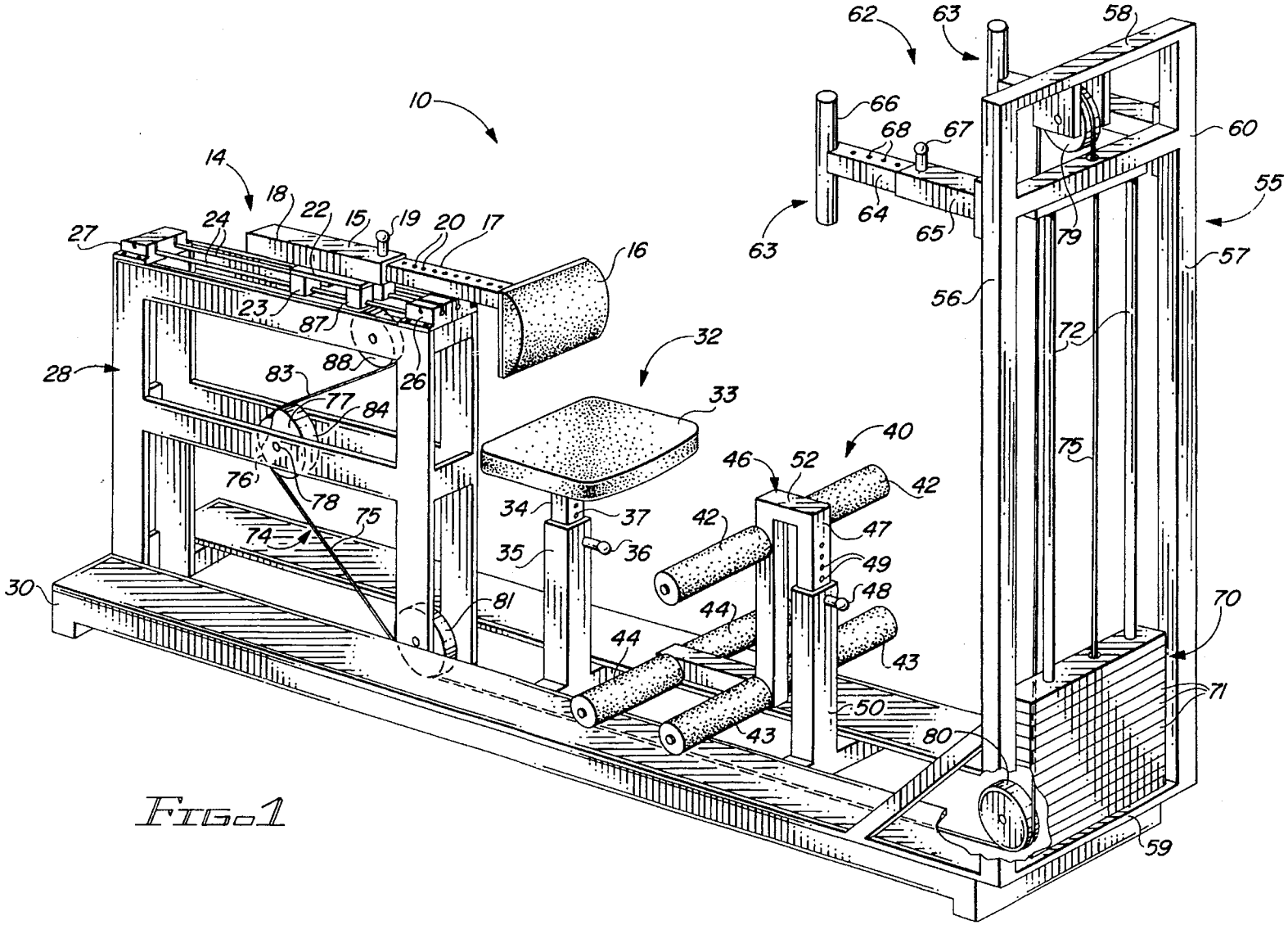
FIG. 1 is a perspective view of an abdominal muscle exercise machine usable in practicing the method in accordance with the principles of the invention.

The principles of the invention are illustrated with reference to an abdominal exercise machine 10 shown in FIGS. 1–3 for linearly applying a resistance in a controlled variable way to the back of a user 12 during contraction and lengthening of the abdominal muscles. The fully contracted state of the abdominal muscles corresponds to the fully flexed position of the trunk, remindful of the raised back of a frightened cat depicted in Halloween decorations.

The apparatus 10 comprises a linear motion assembly 14 having a horizontally movable elongated push-rod or plunger 15, to a front free end of which is mounted a convex-shaped pad 16. The plunger 15 includes coaxial telescoping inner and outer tubular members 17, 18 and means, such as a pin 19 attached to tube 18 engageable in a selected one of a plurality of holes 20 of tube 17, for fixing the length of extension of the padded end 16 relative to the tube 18. The tube 18 is mounted on a carriage 22 having bearing pillow blocks 23 arranged to transport the carriage 22 and the tube 18 longitudinally along spaced parallel horizontal rails 24. The opposite ends of the rails 24 are captured within aligned apertures of opposing end supports 26, 27 mounted in elevated position atop a framework 28 fixed at the rear of a base 30. The assembly 14 may, for example, suitably be a double shaft, end supported linear motion system of the type commercially available from Thomson, Port Washington, N.Y.

A seat assembly 32, comprising a horizontally planar cushion 33 centrally supported in elevated position atop a vertical column 31, including coaxial inner and outer tubular members 34, 35, is attached to the base 30 ahead of the framework 28. A pin 36 on member 35 cooperates with holes 37 on member 34 to provide adjustment of the height of cushion 33 relative to the base 30 and, thus, relative to the padded end 16 of plunger 15. The horizontal spacing of the seat assembly 32 relative to the pad 16 is controlled by the placement of pin 19 relative to the holes 20 of plunger 15.

A leg nest assembly 40 is attached to base 30 in spaced relationship ahead of seat assembly 32. The assembly 40 includes a plurality of oppositely laterally extending pairs of cylindrical leg supports pads 42, 43, 44 supported on a rearwardly facing L-shaped portion 45 of a carrying bracket 46. The pads 42 and 43 are supported in vertically spaced positions above one another and the pads 43, 44 are supported in horizontally spaced positions ahead of one another on the portion 45. The bracket 46 also has a downwardly-extending upright portion 47 ahead of portion 45 which interconnects in coaxial telescoping relationship with a hollow upright tubular member 50. The portions 45, 47 are connected at respective upper ends by a longitudinally extending crosspiece 52. The lower end of member 50 is fixed to base 30, and a pin 48 on member 50 cooperates with holes 49 on portion 47 to adjust the elevation of the bracket 46 relative to the seat 33 and pad 16.

Extending up from base 30 at the front of machine 10 is an open rectangular header 55 comprising laterally spaced columns 56, 57 connected at upper and lower ends by lateral crosspieces 58, 59 and at an intermediate elevation by a lateral crosspiece 60. An arm bracing assembly 62, comprising left and right handles 63, extends horizontally rearwardly from the header 55. Each handle 63 includes coaxial telescoping inner and outer tubular members 64, 65. A vertical rod-like hand grip 66 is fixed proximate the rear of each member 64. Pins 67 on members 65 and holes 68 on members 64 are selectively interengageable to fix the horizontal spacing between the grips 66 and the seat assembly 32.

A conventional weight-selectable weight stack 70 is positioned in the gap between the columns 56, 57. The stack 70 comprises a plurality of weight elements 71 mounted for vertical movement on parallel laterally-spaced rails 72 whose opposite ends are respectively attached to the crosspieces 59, 60. A cable and pulley system 74 connects the weight stack 70 to the carriage 22 of the linear motion assembly 14. A first cable, chain or similar flexible lineal element 75 is fixed at one end to a selected number of weight elements 71 of stack 70 and at an opposite end to a point 76 on the perimeter of a cam 77 which is connected to a shaft 78 rotatably supported on the framework 28. Intermediate portions of the cable 75 are passed circumferentially around circular redirectional pulleys or sprockets 79, 80, 81 which are respectively rotatably mounted adjacent the crosspiece 58, crosspiece 59 and forward lower end of framework 28. A second cable, chain or similar flexible lineal member 83 has one end connected at a point 84 on the circumference of a pulley or sprocket 86 and another end connected to a point 87 at the underside of carriage 22. The pulley 86 is coaxially mounted for rotation on shaft 78 adjacently secured to cam 77. An intermediate portion of the cable 83 passes circumferentially around a redirectional pulley or sprocket 88 which is rotatably mounted at the forward upper end of framework 28.

Figure 2A:
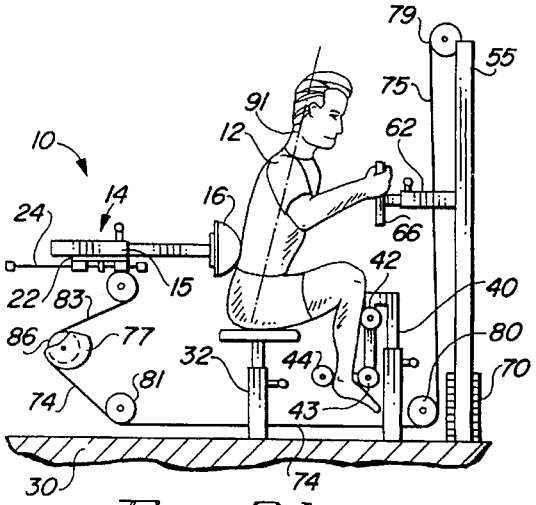
FIGS. 2A–2C are progressive schematic views helpful in understanding the operation of the apparatus of FIG. 1.
Figure 2B:
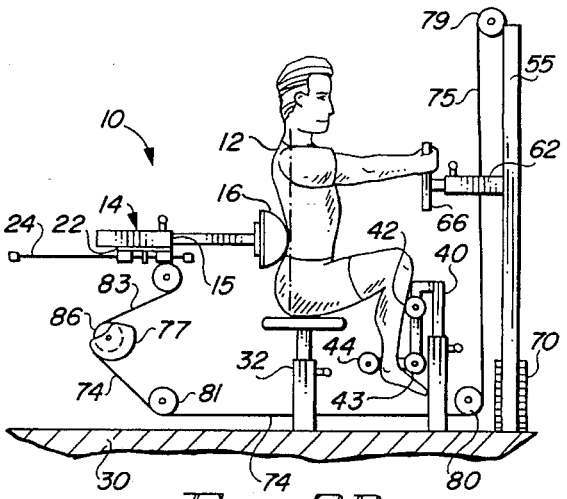
Figure 2C:
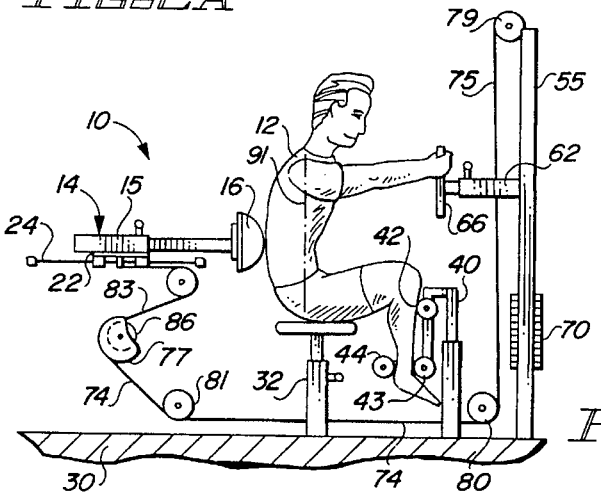

As shown with reference to FIGS. 2A–2C, the linear motion assembly 14 is positioned relative to the base 30 and, thus, the seat assembly 32 so that the padded end 16 of the piston 15 will contact the middle or lower back of the seated user 12. The leg nest assembly 40 is positioned so that each lower leg of the seated user 12 will be captured by the pads 42, 43, 44 to restrain movement of the thighs. The first pad 42 on each side is positioned to abut the anterior tibial tuberosity of each leg; the second and third pads 43, 44 abut the anterior and posterior aspects, respectively, of the lower shin area. The pads 42, 43, 44 serve to hold the knee in a roughly 90° angle of flexion. The arm bracing assembly 62 is positioned so that the grips 66 can be grasped by the hands of the user 12 to hold the arms outstretched. Cam 77 may be a cam of the type known for conventional exercise machines which use a cable fixed to a cam, redirectional pulleys and a weight stack to provide balanced variable resistance against movement of a padded member by a user. The general size and shape of cam 77; radii of the redirectional pulleys; and angles and distances between cam and pulley rotational axes can be determined using known techniques according to a strength curve developed for the abdominal muscular structure being exercised.

The operation of machine 10 is illustrated with reference to FIGS. 2A–2C. FIG. 2A shows the user in the machine entry position; FIG. 2B shows the user in the "loaded" or torso-extended/abdominal-muscle-stretched position; and FIG. 2C shows the user in the torso-flexed/abdominal-muscle-contracted position.

In operation, the height of column 31 of seat assembly 32 and height of L-shaped portion 45 of leg nest assembly 40 are adjusted so the user 12 (FIG. 2A) sits upright on cushion 33 with pad 16 contacting the user's back midway between the shoulders and the hips, thighs extending horizontally forward, and knees bent to approximately 90° flexion with the lower legs depending vertically. Each lower leg is rested in the corresponding three pads 42, 43, 44 of nest 40. Pad 42 abuts the anterior tibial tuberosity to supply indirect counterforce through the length of the femur to the resistance force of stack 70 applied through the plunger 15 (see FIG. 3). Pads 43, 44 abut the lower shin to hold the knee in its right angle flexion.

The arms of the user 12 are brought into outstretched positions (from the positions of FIG. 2A to those of FIG. 2B) with the hands abutting the grips 66 for bracing as in a locked-out position of a bench press or a stiff-arm. In anatomical terms, the shoulders are flexed anteriorly approximately 90° and the elbows are extended to anatomical zero (FIG. 2B). The arms are held horizontal with the heel of each hand abutted to the grips 66. The handles 63 and outstretched arms serve a parallel purpose to the first lower leg pads 42 and the femurs. Combined, they supply indirect counterforce to the gravitational force resistance of the stack 70 applied horizontally linearly against the back. There will, thus, exist upper and lower parallel counterforce vectors at the shoulders and hips directed equally and oppositely to the machine force vector, as shown by the force vectors in FIG. 3, as the user's back 90 and the pad 16 are moved from their solid line positions 90, 16 (corresponding to the abdominal-stretched view of FIG. 2B) to their dot-dot-dashed positions 90', 16'(corresponding to the abdominal contracted view of FIG. 2C).

Figure 3:
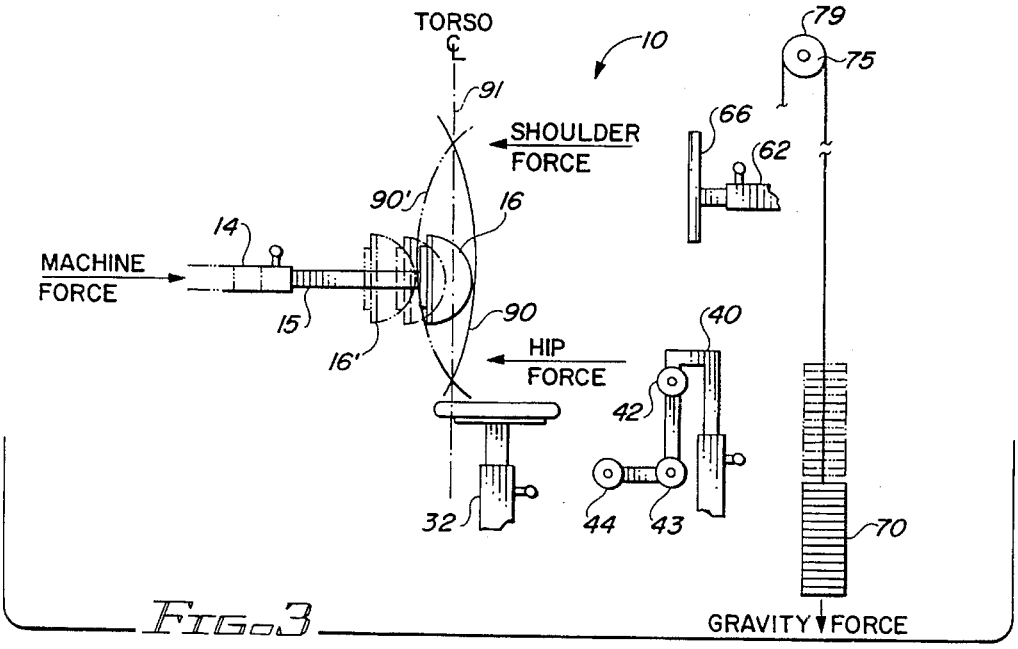
FIG. 3 is a diagram showing the forces acting on the user during the operation shown in FIGS. 2A–2C.

The force generated by the user during torso flexion (moving from the position of FIG. 2B to that of FIG. 2C) effects a linear posterior movement of the center of the back (viz. movement of center of back in movement from position 90 to position 90' in FIG. 3) which is resisted by the padded plunge 15. The padded end 16 is shown positioned to broadly abut the middle of the back, roughly halfway between the shoulders and hips. The seat 32 and leg nest 40 heights are adjustable, however, not only to facilitate consistent placement at the same back location for individuals of differing stature, but also to enable the location of application of the machine force (higher or lower on the back) to be varied for the same individual, if desired. The plunger pad 16 is the primary contact between the body and the machine's resistance drive mechanism. Although the shown drive mechanism is a cable and pulley arrangement for applying gravitational force on a weight stack in a controlled variable way, it will be appreciated that other fixed and variable resistance sources may also be used, including barbell-plate weight baskets, rubber cords, springs, and electromagnetic resistance engines.

To make effective and safe use of the machine 10, the user 12 should first determine his safe but fullest range of motion. As part of his preparations, after setting the seat height so that the pad 16 will roughly centrally contact his back, he selects a weight setting at stack 70 to a magnitude he will be unable to move. If such a setting is not available, provision may be made for temporarily anchoring the stack 70 or cable 75 to the base 30. The extension of the plunger member 17 relative to member 18 is then adjusted to a middle position by moving pin 19 to a middle one of the holes 20. The user 12 then sits on the seat 33 and places his legs in the nest 40 and the heels of his hands against the handles 63, lightly grasping the grips 66.

The user 12 is now seated as shown in FIG. 2A, with torso leaning slightly forward at the hips and waist due to the projection of the pad 16 into the user's back. In this position, a torso centerline 91 (represented by a straight line drawn from the shoulders to the hips) will be slanted forwardly, as shown.

From this initial position, the user then begins to slowly straighten his arms, carefully locking his elbows. By straightening his arms, the shoulders are pushed back, making the torso centerline 91 more vertical. As the user 12 straightens his arms, the piston pad 16 is driven into the user's back to extend the torso between the shoulder and hip joints, bringing the user 12 into the "loaded" position shown in FIG. 2B. How far the spine 90 is extended (see solid line position of spine 90 in FIG. 3) is voluntarily controlled by the user 12 within the bounds of discomfort experienced when the arms are straightened.

If the user 12 can completely straighten his arms without discomfort, he bends his arms slowly to unload his torso structure, and exits the machine. He then advances the plunger 15 moving the pin 19 backward one hole 20—increasing potential torso extension—and repeats the entire process. If user 12 cannot straighten his arms without discomfort, the process is repeated in the same way, but by retreating plunger 15 by one hole 20.

Once the user ascertains the first plunger extension for which he is unable to slowly and comfortably straighten his arms, he moves the pin 19 into the next hole 20 forward for which straightening can still be done comfortably, and records this plunger adjustment as his safe and complete range of motion setting for the exercise. Repeating the procedure in this manner, the user 12 determines what setting provides a maximum safe stretch/extension with maximum resistance to back movement by the weight stack 70. Once the setting for a particular user 12 is determined, machine 10 can then be used on a regular basis without the necessity for that user 12 to repeat the proper setting determination process.

During abdominal muscle strengthening usage, user 12 selects a weight of stack 70 permitting complete movement from a moderate stretch (torso extension FIG. 2B) to a complete contraction (torso flexion FIG. 2C). A moderate stretch is that stretch attained by arching the back against a machine force applied by a weight of stack 70 selected for routine exercises. This is considerably less than the magnitude of weight used for the preliminary range of motion (plunger adjustment) determination.

The header columns 56, 57 can be provided with grid lines (not shown) to enable the user 12 to visually judge the adequacy of the vertical stroke of the weight stack 70 in front of him due to movement of the plunger 15 during the exercise. It is preferable that the user arch his back slowly in accordance with the teachings of the Super Slow™ protocol originated by the inventor. Once the exercise set is complete, the user 12 unloads the torso by permitting his arms to bend back into the FIG. 2A position. He then exits the machine. If at any time the user 12 feels jeopardized during the exercise, he can simply unload by bending his arms. In this way, the user 12 has complete control over loading, unloading, comfortable range of motion, and the like.

The pad 16 is preferably convex-shaped, as shown, so that it can fit the concave contour of the lumbar area of the back during extreme stretch/extension. This places loading over a maximized surface area rather than a confined point or on just one vertebrae. As the torso is flexed, this contact surface area reduces as the body's contour becomes more convex. However, as torso flexion progresses, the back remains protected because resistance from the weight stack applied through the cam is decreasing and architectural arch support of the back is increasing.

Figure 4:
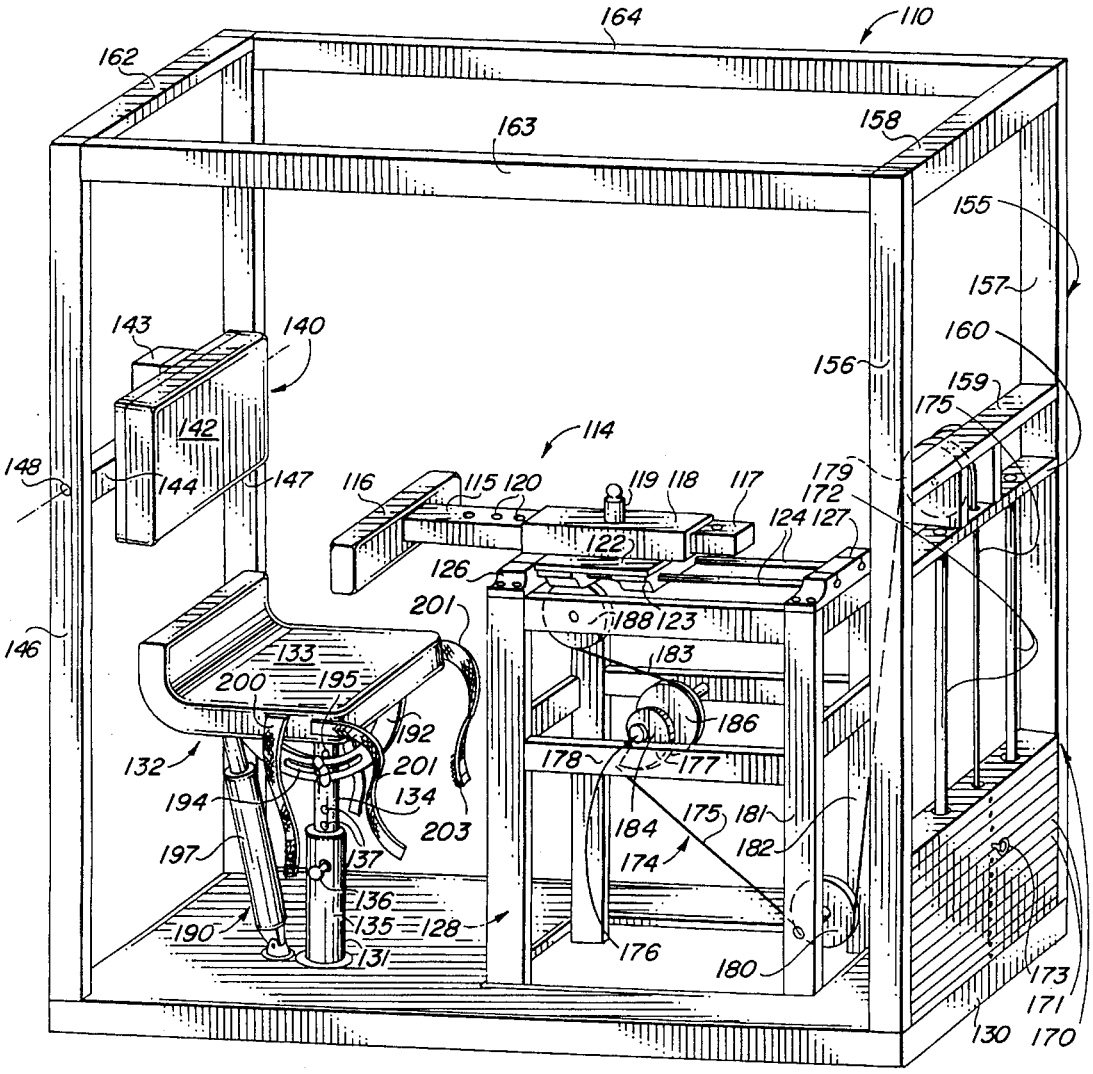
FIG. 4 is a perspective view of another abdominal muscle exercise machine usable in practicing the method of the invention.

The principles of the invention are also illustrated with reference to an abdominal/back muscle exercise machine 110 shown in FIG. 4 for linearly applying a resistance in a controlled variable way to the trunk of a user during contraction or lengthening of the abdominal muscles or the erector spinae muscles, depending upon the attitude of body positioning of the user. Contraction of the erector spinae muscles of the back corresponds to posterior extension, or backward arching, of the trunk. Lateral contraction of the abdominals corresponds to lateral flexion, or sideways flexion, of the trunk.

The apparatus 110 comprises a linear motion assembly 114 having a horizontally movable elongated push-rod or plunger 115, to a front free end of which is mounted a generally perpendicular, laterally extending pad 16. The plunger 115 includes coaxial telescoping inner and outer tubular members 117, 118 and means, such as a pin 19 attached to tube 118 engageable in a selected one of a plurality of holes 120 of tube 117, for fixing the length of extension of the padded end 116 relative to the tube 118. The tube 118 is mounted on a carriage 122 having bearing pillow blocks 123 arranged to transport the carriage 122 and the tube 118 longitudinally along spaced parallel horizontal rails 124. The opposite ends of the rails 124 are captured within aligned apertures of opposing end supports 126, 127 mounted in elevated position atop a framework 128 fixed at a front portion of a base 130. The assembly 114 may, for example, suitably be a double shaft, end supported linear motion system of the type commercially available from Thomson, Port Washington, N.Y.

A seat assembly 132, comprising a user supporting, generally horizontally disposed cushioned seat 133 supported in elevated position atop a vertical column 131. The column 131 includes coaxial inner and outer tubular members 134, 135, and is attached to the base 130 behind the framework 128. A pin 136 on member 135 cooperates with holes 137 on member 134 to provide adjustment of the height of seat 133 relative to the base 130 and, thus, vertically relative to the padded end 116 of plunger 115. The horizontal spacing of the seat assembly 132 relative to the pad 116 is controlled by the placement of pin 119 relative to the holes 120 of plunger 115.

A back rest assembly 140 is attached to base 130 in elevated relationship at the back of seat assembly 132. The assembly 140 includes a cushioned backrest 142, supported on a vertically extending column 143 which is carried on a horizontal, laterally extending cross member 144. Means, such as pin 145 similar to pins 119 and 136, is provided to enable vertical adjustment of the column 143 relative to the member 144 (see, FIG. 5A). The ends of member 144 are mounted between laterally spaced posts 146, 147 extending upwardly at the rear corners of base 130. The member 144 may optionally be made pivotable about a lateral axis passing through a pivotal connection 148. The height of the backrest 142 above the seat 133 is controlled by selecting the position of the column 143 relative to the cross-member 144.

Extending up from base 130 at the front of machine 110 is an open rectangular header 155, comprising laterally spaced front corner posts 156, 157 connected at upper ends by lateral crosspiece 158 and at vertically spaced intermediate elevations by lateral crosspieces 159, 160. A lateral crosspiece 162 similarly connects upper ends of the rear corner posts 146, 147; and upper ends of posts 146, 156 and 147, 157 are respectively joined by laterally spaced, longitudinally extending top runners 163, 164 in order to add rigidity to the overall structure of machine 110.

A conventional weight-selectable weight stack 170 is positioned in the gap between the posts 156, 157. The stack 170 comprises a plurality of weight elements 171 mounted for vertical movement on parallel laterally-spaced rails 172 whose opposite ends are respectively attached to the crosspiece 160 and base 130. A cable and pulley system 174 connects the weight stack 170 to the carriage 122 of the linear motion assembly 114. A first cable, chain or similar flexible lineal element 175 is fixed at one end to a selected number of weight elements 171 of stack 170, and is fixed at an opposite end to a point 176 on the perimeter of a cam 177 which is connected to a shaft 178 rotatably supported on the framework 128. Intermediate portions of the cable 175 are passed circumferentially around circular redirectional pulleys or sprockets 179, 180 which are respectively rotatably mounted between crosspieces 159, 160 at an intermediate elevation of header 155 and legs 181, 182 at the lower end of framework 128. A second cable, chain or similar flexible lineal member 183 has one end connected at a point 184 on the circumference of a pulley or sprocket 186 and another end connected to a point at the underside of carriage 122. The pulley 186 is coaxially mounted for rotation on shaft 178 adjacently secured to cam 177. An intermediate portion of the cable 183 passes circumferentially around a redirectional pulley or sprocket 188 which is rotatably mounted at the back upper end of framework 128.

The seat assembly 132 may optionally include a swivel mechanism 190 that enables the seat 133 to be tilted forwardly and backwardly about a pivotal connection 191 (see FIG. 5A) between the underside of seat 133 and the top of column 131. A depending arcuate member 192, having ends connected to seat 133 ahead and behind the connection 191, includes an arcuate slot 194. The shank of a threaded element 195 is passed through the slot into engagement with a threaded bore of the tubular member 134. Element 195 includes an enlarged head with radially extending projections that enables the element 195 to be hand-tightened to lock the arc 192 against movement relative to the column 131. When element 195 is loosened, the seat 133 can swivel within the limits defined by the travel of the shank of element 195 within the slot 194. In the illustrated embodiment, slot 194 subtends an arc of 30° to limit the swivel to ±15° from horizontal. The arcuate member 192 extends in a longitudinal plane to prevent side-to-side swiveling. To lock the seat 133 against swivel motion, element 195 is tightened down with seat 133 set at a desired fixed angle of tilt. A shock absorber or similar mechanism 197 is connected between the rear of seat 133 and the base 130, to damp the swivel motion of the seat about the point 191, to keep the swivel of the seat under control of the user.

Cam 177 may be a cam of the type known for conventional exercise machines which use a cable fixed to a cam, redirectional pulleys and a weight stack to provide balanced variable resistance against movement of a padded member by a user. The general size and shape of cam 177; radii of the redirectional pulleys; and angles and distances between cam and pulley rotational axes can be determined using known techniques according to a strength curve developed for the abdominal muscular structure being exercised.

Figure 5A:
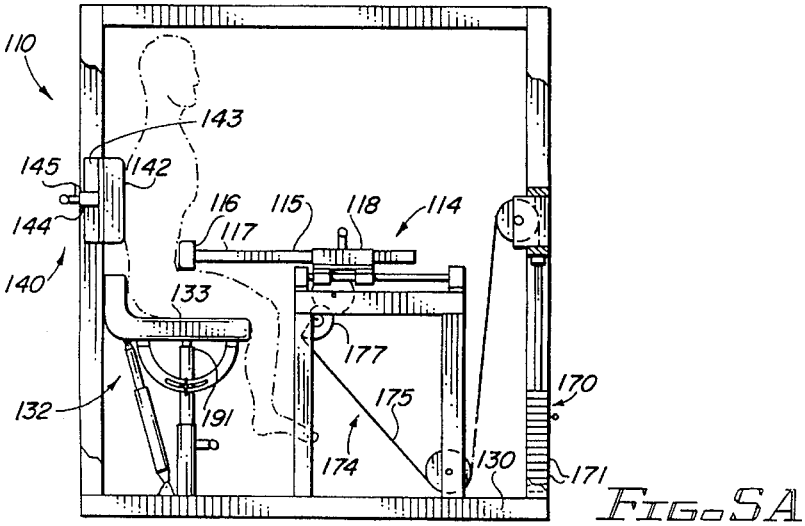
FIGS. 5A–7B are progressive schematic views helpful in understanding the operation of the machine of FIG. 4 in exercises according to the method of the invention involving posterior extension, lateral flexion and posterior extension with swivel, respectively.
Figure 5B:
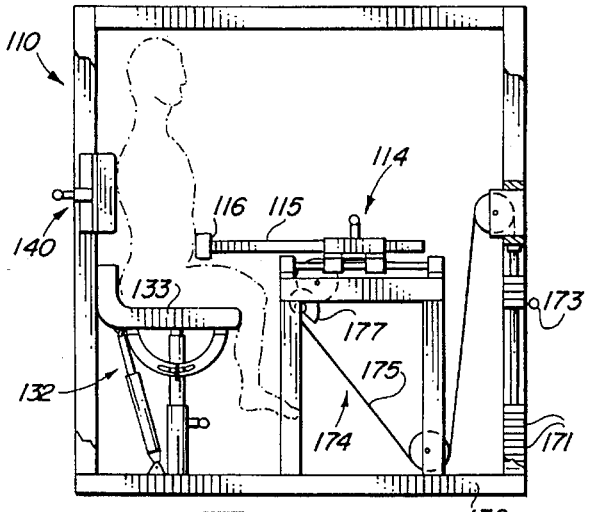

The operation of machine 110 for use in a lumbar extension, lower back (erector spinae) muscle strengthening exercise is illustrated with reference to FIGS. 5A–5B. FIG. 5A shows the user in the exercise start position; and FIG. 5B shows the user in the posterior extension position, with the torso extended backwards and the plunger 115 pushed forward to raise the selected part of the weight stack 170 at an elevation rate determined by the shape of cam 177.

The heights of seat 133 and backrest 142 are adjusted so that, in the start position (FIG. 5A), the user sits upright on cushion 133 with backrest 142 supporting the user's back in the dorsal/lumbar region, and with pad 116 contacting the user's mid-ventral trunk at the front of the abdomen. The user's thighs lie horizontally forwardly on seat 133, with knees bent to let the lower legs hang freely down ahead of the seat 133. The user's arms hang freely down at the user's sides. The position of the plunger inner member 117 is set relative to the plunger outer member 118 so that during backward extension of the trunk, the user's abdomen pushes against the plunger pad 116 to move the plunger arm 115 linearly forward on the carriage 122. This movement is opposed by the weight stack 170 which is attached to the carriage 122 by means of the cable and pulley system 174. As the carriage 122 advances, the effective radius of the cam 177 about which the cable 175 wraps varies, to vary the elevation rate of the weight stack. This varies the force resisting lined displacement of the plunger 115.

The plunger pad 116 is the primary contact between the body and the machine's resistance drive mechanism. Although the shown drive mechanism 174 is a cable and pulley arrangement for applying gravitational force on a weight stack 170 in a controlled variable way, it will be appreciated that other resistance sources may also be used, including barbell-plate weight baskets, rubber cords, springs, and electromagnetic resistance engines.

The header columns 156, 157 can be provided with grid lines (not shown) to enable the user to visually judge the adequacy of the vertical stroke of the weight stack 170 in front of him due to movement of the plunger 115 during the posterior extension step of the exercise. It is preferable that the user arch his back slowly in accordance with the teachings of the Super Slow™ protocol originated by the inventor. Once the extension (FIG. 5B) has been achieved, the user reverses movement of the torso while the torso remains under load, by slowly bringing his spine and torso back into the FIG. 5A position.

Figure 6A:
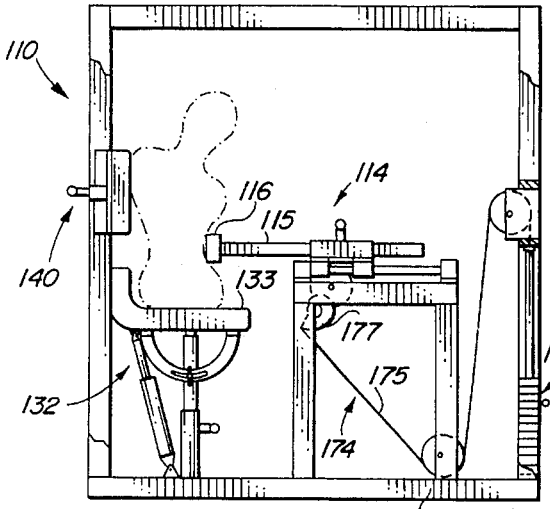
Figure 6B:
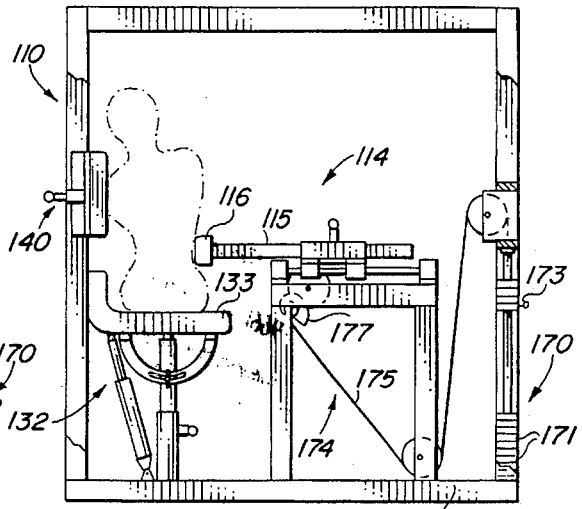

The operation of the machine 110 for use in a lateral flexion, abdominal muscle strengthening exercise is illustrated with reference to FIGS. 6A–6B. FIG. 6A shows the user in the exercise start position; and FIG. 6B shows the user in the lateral flexion position, with the trunk contracted sideways in the direction of flexion (bending toward the left in FIG. 6B). For lateral flexion, the user is seated sideways on seat 133, with plunger 116 contacting the user's side (right side in FIG. 6A) midway between the hips and shoulders, with the spine in a vertical or slightly oppositely flexed starting position. The user then flexes laterally toward the opposite side (left side in FIG. 6B), so the torso moves to the plunger pad 116 and plunger arm 115 forwardly (to the right in FIG. 6B) against the variable resistance of the weight stack 170 applied through the cable and pulley system 174. As with the posterior extension exercise, described previously, the variation in resistance is controlled by the changing effective radius of the cam 177 as the cam 177 is rotated.

Figure 7A:
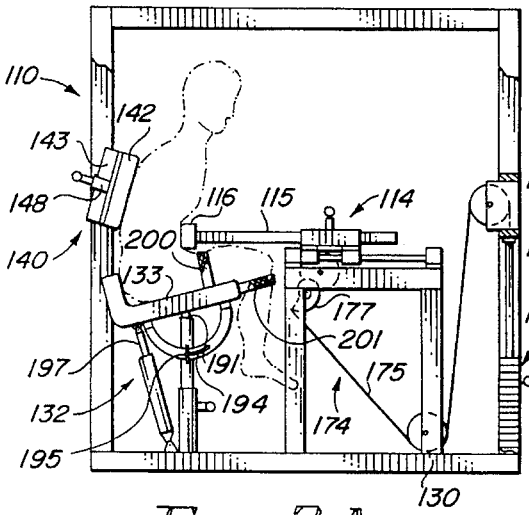
Figure 7B:
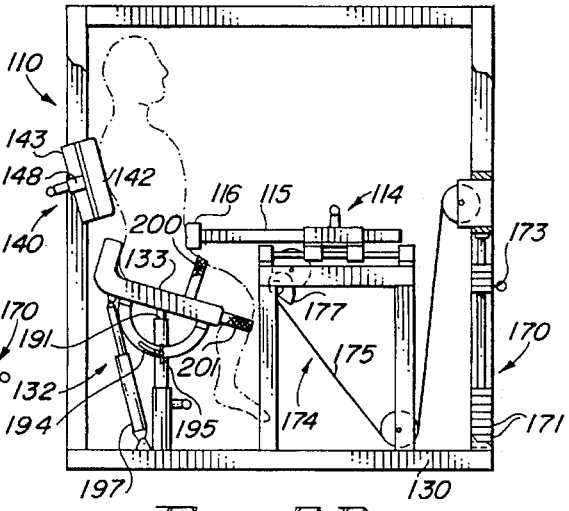

FIGS. 7A–7B illustrate the operation of machine 110 for a posterior extension exercise as in FIGS. 5A–5B, except where the seat 133 and backrest 142 are freed for pivoting. The user begins the exercise in the position shown in FIG. 7A, seated with the seat 133 tilted back, 15° counterclockwise about pivot point 191, with the element 195 in its rearmost position in arcuate slot 194. The user's trunk is flexed slightly forwardly, with the dorsal/thoracic region contacting the backrest 142 to tilt it forwardly (in the clockwise direction) about the pivot point 148. As with the non-swiveling, posterior extension exercise, the pad 116 is adjusted to contact the front of the abdomen. The user then contracts the erector spinae to extend the spine backwardly (lumbar extension) to the position shown in FIG. 7B, moving the plunger 115 linearly against the opposing variable resistance of the weight stack 170. The extension is, however, accompanied by a forward tilting (clockwise rotation about the point 191) of the seat 133 and backward tilting (counterclockwise rotation about the point 148) of the backrest 142. The seat 133 tilts forwardly until the element 195 reaches its forwardmost position of travel within the track 194. This exercise is generally the same as that of the straight lumbar extension exercise of FIGS. 5A–5B, except the tilting of the seat 133 and backrest 142 permits a wider range of movement. The shock absorber 197 serves to dampen the seat tilting motion, so that it does not occur too readily. To prevent the user from sliding forward in the seat 133 during the forward tilt, thigh and knee belts 200, 201 are provided on seat 133 to respectively go around the thighs and knees of the user. The belt ends are provided with adjustable fasteners, such as Velcro™ hook-and-eye fastener elements 203 (FIG. 4).

Those skilled in the art to which the invention relates will appreciate that the particular configurations of the linear motion assembly 114, seat assembly 132, backrest assembly 140, and header 155, and cable and pulley system 174 can be varied, and that various other substitutions and modifications can be made to the described embodiments without departing from the spirit and scope of the invention as described by the claims below.

What is claimed is:

1. A method of exercising lower back muscles of a person comprising the steps of:

placing the person in a seated position with the person's upper torso region braced against an upper back rest and the person's pelvic region braced against a lower back rest, the person's thighs extending generally perpendicular to the person's back;

actuating a plunger mechanism against the person's abdominal region with a substantially constant force over a preselected range of motion; and causing the person to alternately push inward and outward against the plunger mechanism by flexing of the person's pelvic and lower back muscles with concurrent pivoting of the person's upper back with respect to the person's lower back.

2. The method of claim 1 wherein the step of placing includes the step of positioning the person such that the upper back rest engages the person from a side at a shoulder such that the step of pivoting is in a lateral plane.

3. The method of claim 1 wherein the step of placing includes the step of positioning the person such that the upper back rest engages the dorsal/lumbar region of the person's back and pivoting of the person's back comprises pivoting of the person's front abdominal region toward and away from the person's thighs.

4. The method of claim 3 and including the further steps of:

restraining the person's back at about the shoulder blade area; and allowing the person's hips to pivot by raising and lowering the person's legs with respect to the hips as the plunger mechanism is advanced and withdrawn.

5. The method of claim 4 wherein the person is seated on a seat pivotable about an axis transverse to the direction of motion of the plunger mechanism and wherein the step of allowing the person's hips to pivot includes the step of pivoting of the seat.

* * * * *